US005764122A

United States Patent [19]

Müller et al.

[11] Patent Number: 5,764,122

[45] Date of Patent: Jun. 9, 1998

[54] WINDING ARRANGEMENT OF A COIL

[75] Inventors: Walter Müller, Schwabach; Gerhard Döll, deceased, late of Nürnberg; Helga Luise Friederike Döll, heir, Nuremberg; Rüdiger Günther Döll, heir, Nuremberg; Achim Vitus Döll, heir, Nuremberg; Erwin Hager, Seukendorf, all of Germany

[73] Assignee: Siemens Aktiengesellschaft, Munich, Germany

[21] Appl. No.: 256,458

[22] Filed: Nov. 7, 1994

[51] Int. Cl.[6] ..... H01F 27/28

[52] U.S. Cl. ..... 336/69; 336/187

[58] Field of Search ..... 336/69, 70, 186, 336/187

[56] References Cited

U.S. PATENT DOCUMENTS

| | | | |
|---|---|---|---|
| 2,453,552 | 11/1948 | Stearn | 336/70 |
| 3,221,282 | 11/1965 | Brierley et al. | 336/69 |
| 3,246,270 | 4/1966 | Stein | 336/187 |
| 3,387,243 | 6/1968 | Carpenter et al. | 336/70 |
| 3,528,046 | 9/1970 | Sauer | 336/70 |
| 3,569,883 | 3/1971 | Van Nice | 336/70 |

*Primary Examiner*—Thomas J. Kozma

*Attorney, Agent, or Firm*—Kenyon & Kenyon

[57] ABSTRACT

To simplify coil production, in particular coils used for high-voltage transformers, a conductor is wound on to a winding form. The conductor comprises a plurality of conductor portions. The conductor portions overlap one another partially and are insulated from one another. A conductor and a winding arrangement can be produce with this method.

5 Claims, 2 Drawing Sheets

WINDING ARRANGEMENT OF A COIL

BACKGROUND OF THE INVENTION

The present invention relates to a method for producing a winding arrangement of a coil, to an electric conductor for use with the method and to a winding arrangement produced according to the method.

Winding an electric conductor onto a coil form is a known method of producing a coil, for example, a coil for a transformer. With regard to wired-up winding arrangements, successively winding individual part windings is necessary. The part windings are subsequently wired up to one another. A special type of wired-up winding arrangement is the so-called continuous turn-over winding. Unfortunately, producing a coil having such a winding is very expensive.

The German Patent Publication DE-A1-3214171 discusses such a winding arrangement. The conductor used comprises subconductors which are connected in parallel and series.

The object of the present invention is to specify a method which simplifies the production of a coil. A further object is to provide an electric conductor for use in such a method and to specify the winding arrangement produced according to the method.

SUMMARY OF THE INVENTION

The method of present invention achieves the aforementioned object by joining a plurality of conductor portions such that they at least partially overlap one another but are insulated against one another to form a conductor and winding the conductor. A substantial time saving is achieved by producing a coil in this way. The coil can be wound substantially more quickly by the method of the present invention than heretofore. This is particularly true when a conductor is used in which additional measures, which were heretofore carried out during the winding operation, are performed before the winding operation. This relates, for example, to the insertion of separators for an insulation between windings or an edge protector. The method of the present invention is also suitable for interleaved windings.

In a preferred embodiment of the present invention, at least a part of the conductor is wound onto a winding form with the formation of a disk winding. Particularly large savings in fabrication are possible here, since at least two disk coils are produced during the winding operation. If more than 2 conductor portions overlap in a section of the conductor, a plurality of turns can be produced simultaneously in one rotation of the winding.

A continuous turn-over (i.e., continuously wound) winding step can advantageously follow. In this case, electrically connecting the ends of mutually overlapping conductor portions to one another in a further step is preferred. This eliminates a subsequent step of cutting the conductors to length. As a result, the risk of damage to the already finished winding is reduced. Clean junctions are produced on the coil.

The present invention achieves the aforementioned object of providing a conductor for use in the method by using an electric conductor comprising a plurality of conductor portions, the conductor portions being joined to one another in a partially overlapping manner but insulated from one another. This provides a type of prefabricated conductor which can be processed particularly simply and quickly. The winding time for a coil can thus be reduced depending on the number of parallel conductor portions.

The respective conductor portions can comprise, in this case, a plurality of conductor cores connected in parallel. The conductor portions can also be constructed as transposed conductors. The conductor is therefore also suitable for applications in the energy field, for example for high-voltage transformers.

In a preferred embodiment of the present invention, in each case, two mutually overlapping ends of two conductor portions are constructed to be capable of being electrically connected to one another. The subsequent step of wiring-up the conductor when the coil is finished is particularly facilitated in this way. A subsequent step of adjusting the conductor or cutting the conductor to length is superfluous, or is at least simplified. The joints are thus precisely prescribed.

In a preferred embodiment of the present invention, the conductor portions are separated from one another with spacer inserts. This eliminates the heretofore customary expensive intermediate step of winding of spacer inserts or edge protector rings when winding the transformer. This is particularly true, for the internal region of a coil.

The winding arrangement of the present invention comprises an electric conductor including a plurality of conductor portions. The conductor portions are joined to one another such that they at least partially overlap one another but are insulated from one another. Such a winding arrangement is distinguished by its small boundary dimensions, since the coil can be wound in a substantially more compact manner than heretofore. Moreover, the winding arrangement of the present invention is simpler and quicker to produce.

DETAILED DESCRIPTION

Figure 1:
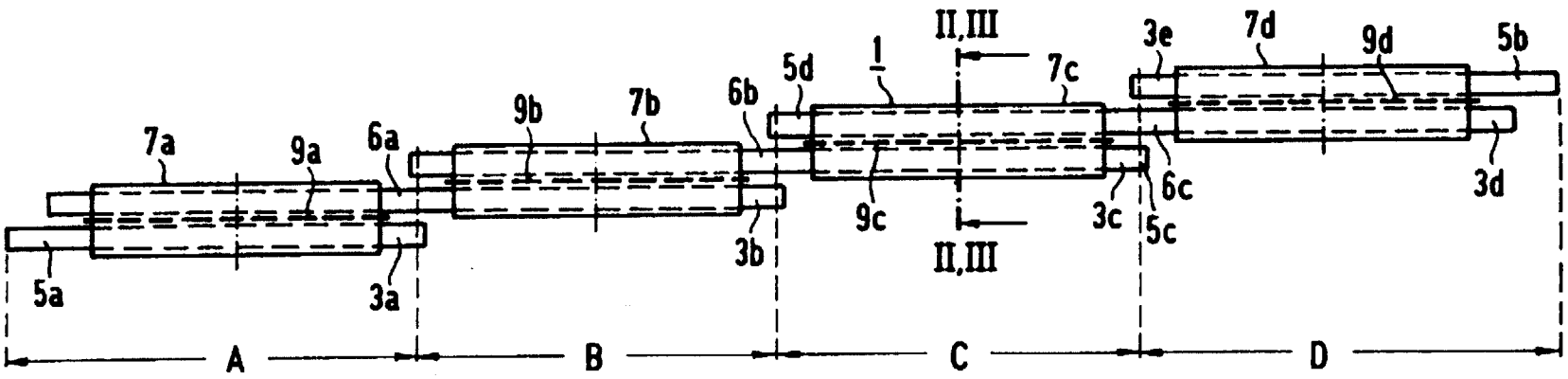
FIG. 1 shows a conductor of the present invention.

FIG. 1 shows an electric conductor 1 for a winding arrangement. The electric conductor 1 comprises a plurality of conductor portions 3*a* to 3*e*. The conductor portions 3*a* to 3*e* are mechanically coupled with one another, at least partially overlapping, but insulated with respect to one another, so that a type of prefabricated conductor is produced. The lengths of the conductor portions 3*a* to 3*e* are prescribed such that, when a coil is wound, conductor sections A to D are assigned to respectively prescribed turns. In this case, the free ends of the conductor portions 3*a* to 3*e* are, if required, dimensioned such that these portions can be electrically connected to one another after winding. This may be shown in the present FIG. 1, for example, with the aid of the free ends 5*c* and 5*d* of the conductor portions 3*c*, 3*d*. If the latter are connected to one another, the conductor 1 is electrically conducted along the conductor sections B, C and D. Transitions between the conductor sections A to D are denoted by the reference symbols 6*a*, 6*b*, 6*c*. The free ends 5*a*, 5*b* of the end-side conductor portions 3*a*, 3*e* form the external terminals of the later winding arrangement. Arranging more than two conductor portions in parallel in a section is also possible.

Figure 2:
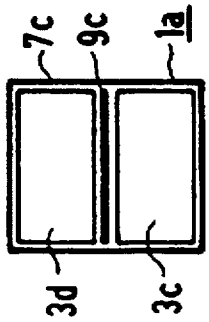
FIG. 2 shows the conductor of FIG. 1 in the cross-section along the line II—II.

The cross-section, shown in FIG. 2, of the conductor 1 from FIG. 1 along the line II—II represents a simple alternative embodiment. The conductor denoted by 1*a* has two conductor portions 3*c*, 3*d*, which are mutually insulated by the separator 9*c*. The conductor portions 3*c*, 3*d* are surrounded by a common insulation 7*c*. The conductor portions 3*c*, 3*d* can comprise one or more conductor cores, for example as a solid conductor or a transposed conductor.

This embodiment of the electric conductor is particularly space saving, since a very closely and compactly wound coil which has very small boundary dimensions can be produced from it.

Figure 3:
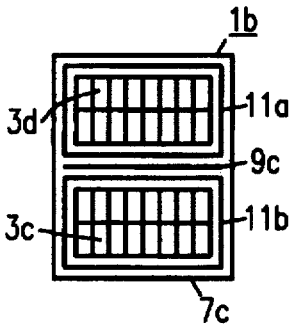
FIG. 3 shows a further conductor in the cross-section along the line III—III of FIG. 1.

The cross-section shown in FIG. 3 illustrates a preferred embodiment of the conductor 1 from FIG. 1. The conductor denoted by 1*b* has two conductor portions 3*c* and 3*d* surrounded, in each case, by a separate insulation 11*a*, 11*b*. The conductor portions 3*c* and 3*d* are, as indicated in the drawing, constructed as interlinked twin transposed conductors. A capacitance-determining separator 9*c* is arranged between the conductor portions 3*c* and 3*d*. The conductor portions 3*c*, 3*d* are surrounded by a common insulation 7*c*. In this embodiment, the common insulation can, if necessary, be designed thinner than in the embodiment shown in FIG. 1. A function of the common insulation 7*c* is to hold the respective conductor portions together or to join them to one another.

Dispensing with the edge protection rings, which have been used in the past for electrical reasons (e.g., for impulse insulation level), is possible due to the common insulation 7*a* to 7*d*.

Figure 4:
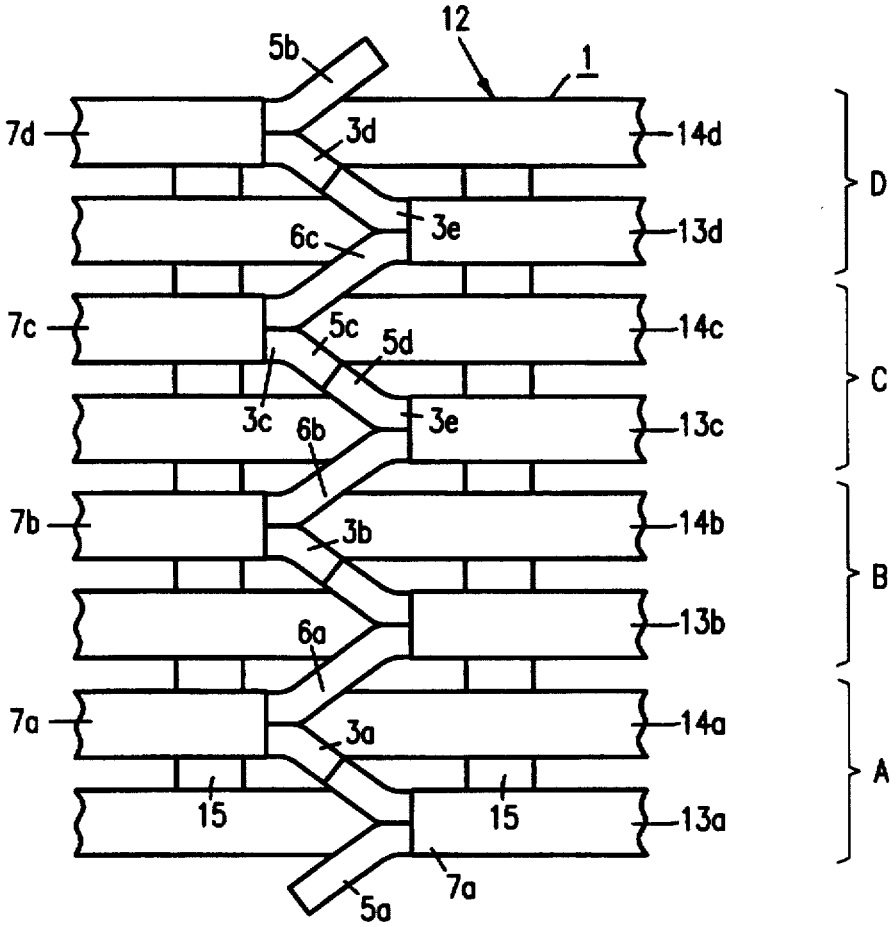
FIG. 4 shows a partial external view of a winding arrangement.

FIG. 4 shows a partial external view of a winding arrangement 12 which uses the conductor 1 shown in FIG. 1. In FIG. 4, the winding arrangement 12 is constructed as a coil with a continuous turned-over (i.e., continuously wound) winding. In this arrangement, the conductor sections A, B, C and D respectively form disk coil pairs 13*a*, 14*a* to 13*d*, 14*d*. The free ends 5*a*, 5*b* of the end-side disk coils 13*a* and 14*d*, respectively, form the terminals for the winding arrangement 12. The individual disk coils 13*a* to 14*d* are separated from one another by spacer inserts 15.

In the partial external view shown, the region of the winding arrangement 12 is shown at which the joints between the conductor portions 3*a* to 3*e* are produced. By way of example for the entire winding arrangement 12, the free ends 5*c*, 5*d* of the conductor portions 3*c* and 3*d* are connected to form a joint between the two disk coils 13*c* and 14*c* of the conductor section C. The transitions 6*a* to 6*c*, which are formed, in each case, by the conductor portions 3*b* to 3*d*, lie between the respective disk coils of two adjacent conductor sections. For example, the transition 6*c* lies between the conductor sections D and C with the disk coils 13*d* and 14*c*. A further joint between the adjacent disk coils is situated (not represented in more detail), as is customary in continuous turn-over windings, on the inside of the winding arrangement 12. Such a transition point corresponds in FIG. I to the respective centers of the conductor sections A to D.

If, by way of example, a conductor in accordance with FIG. 1 is processed on a winding form to produce a winding arrangement 12 in accordance with FIG. 4, substantial advantages in fabrication can be achieved. Despite the increased outlay in the production of the conductor 1, savings are achieved in the total winding arrangement 12. This relates, in particular, to application of disk coils and of continuous turn-over windings. Despite much reservation in expert circles with regard to manipulability, it has been found that the use of the proposed prefabricated conductor 1 is particularly favorable, in particular in large winding arrangements, for example for high-voltage transformers. In addition, the following advantages have further emerged from trials with the method indicated:

Shielding angles on the inside of winding arrangements or of coils for transformers can be eliminated without replacement.

Up to four normal double coils can be wound from twin transposed conductors.

The free ends 5*c*, 5*d*, which are to be electrically connected to one another, are always situated in the correct position after winding of the coil.

Capacitance-determining inserts can already be contained in the prefabricated conductor. The steps of punching and inserting radial shims during the winding of the winding arrangement is eliminated.

If required, it is also possible to prefabricate only one input group of a winding arrangement or a few groups.

The elimination of shielding angles produces a lower hot-spot temperature in the winding arrangement.

In the application of the present invention in the high-voltage range, the separators 9*a* to 9*b* are preferably used at thicknesses of between 0.1 to 2 mm, in particular 0.3 to 1 mm. Voltage stresses of between 50 to 150 KV are taken into account in this case.

It is claimed:

1. A winding arrangement of an electric coil comprising:

a plurality of conductor portions: and a plurality of insulator portions, wherein:

the conductor portions are arranged in at least three pairs, a first and a second pair sharing a first common conductor portion and the second and a third pair sharing a second common conductor portion, each pair of conductor portions having an overlapping section in which the conductor portions of the pair of conductor portions overlap, each insulator portion is arranged at the overlapping section of each of a corresponding pair of conductor portions, and includes:

an insulating separator arranged between the conductor portions of the corresponding pair of conductor portions, and a common surrounding insulator covering the corresponding pair of conductor portions and mechanically connecting together the conductor portions of the corresponding pair of conductor portions, each overlapping section forms a group of disk coils, each group of disk coils including at least two disk coils wound in opposite directions, a first group of disk coils is arranged adjacent to a second group of disk coils which is arranged adjacent to a third group of disk coils, and the first and second groups of disk coils are electrically coupled together by a common conductor portion and the second and third groups of disk coils are electrically coupled together by a junction between two conductor portions.

2. The winding arrangement of claim 1, wherein each disk coil includes a number of disk windings.

3. The winding arrangement of claim 2 wherein at least one of said disk windings is a continuous turn-over winding.

4. The winding arrangement of claim 1, wherein each conductor portion includes a plurality of mutually twisted sub-conductors.

5. The winding arrangement of claim 1, wherein the groups of disk coils are coupled in a stepwise fashion and wherein the winding arrangement comprises a plurality of further disk coils which are coupled in a stepwise fashion.

* * * * *